252-151 AU 157 EX
4/30/85 XR 4,514,325

United States Patent [19]
Russo et al.

[11] Patent Number: 4,514,325
[45] Date of Patent: Apr. 30, 1985

[54] AQUEOUS METAL TREATING COMPOSITIONS AND METHOD OF USE

[75] Inventors: Anthony Russo, Grand Rapids; Thomas Mauthner, Livonia, both of Mich.

[73] Assignee: J. Hall Company, Grand Rapids, Mich.

[21] Appl. No.: 600,165

[22] Filed: Apr. 13, 1984

[51] Int. Cl.[3] ..... C11D 1/28
[52] U.S. Cl. ..... 252/557; 252/533; 252/538; 252/552; 252/143; 252/151; 134/3; 134/40
[58] Field of Search ..... 252/533, 538, 549, 552, 252/557, 559, 173, DIG. 14, 143, 151; 134/3, 40; 260/400, 401

[56] References Cited

U.S. PATENT DOCUMENTS

| | | | |
|---|---|---|---|
| 2,556,108 | 6/1951 | Ruedrich | 260/400 |
| 2,867,586 | 1/1959 | Weil et al. | 252/557 |
| 2,951,808 | 9/1960 | Nelson | 260/400 |

*Primary Examiner*—Paul Lieberman
*Assistant Examiner*—Hoa Van Le
*Attorney, Agent, or Firm*—Krass and Young

[57] ABSTRACT

This invention relates to water based and water dilutable compositions containing about 5 to 20% by weight of water insoluble lipophilic organic solvents and a coupling agent comprising a compound having the formula

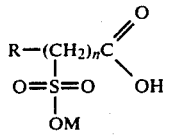

where R—$(CH_2)_n$ is the residue of a sulfonated monounsaturated $C_{12}$ to $C_{18}$ fatty acid having the C—S attachment in one of the carbon atoms of the residue and M is an alkali metal, alkaline earth metal or amine, the weight ratio of solvent to coupling agent being from about 1:1 to 2:1. The composition is useful for metal cleaning, rust removing and phosphatizing.

15 Claims, No Drawings

AQUEOUS METAL TREATING COMPOSITIONS AND METHOD OF USE

DESCRIPTION

1. Technical Field

This invention relates to water based and water dilutable compositions containing water insoluble halogenated hydrocarbon solvents useful for metal cleaning, rust removing and phosphatizing.

2. Background of the Invention

Many industries, especially automotive producers and metal working firms are engaged in the large scale manufacture of metal components, usually alloy metal components made from iron and steel. The parts are manufactured with a variety of processes which may include stamping, drawing, grinding, broaching and cutting. These processes often require the addition of chemical compounds to the machining media, or involve chemically coating the metals to be formed to prevent metal damage or permit forming to specifications. These compounds may include any of a wide variety of chemicals including oil based or synthetic lubricants, grinding fluids, drawing compounds usually based on fats, soaps and chlorinated oils, heavy metal stearates and oleates, pigmented machine forming compounds containing calcium or magnesium carbonates, and other similar chemicals. After the metal part is properly manufactured, it usually requires thorough cleaning prior to painting or further processing. Some of the cleaning is undertaken using water based compounds where the cleaning compound is sprayed upon the part to be cleaned under high pressure or the part is soaked at elevated temperature with some agitation, and the parts are rinsed. These methods are used when the parts do not have to be scrupulously clean. When absolutely no foreign matter may be left on the parts, metal degreasing machines and solvents have become popular. These machines usually employ a 100% chlorinated hydrocarbon solvent and the parts are cleaned in a one or two step process. The removed chemicals including oils and other machining compounds accumulate in the solvent, and the resulting used solvent is then distilled permitting the distillate to be used again. The large amount of residue, containing the removed soil and approximately 2 to 20% of chlorinated solvent constitutes an environmental problem and is therefore discarded as hazardous waste. Another serious problem is the use of chlorinated solvents within industrial plants and commercial shops where the threshhold limit value (TLV) for chlorinated solvents is relatively low.

It is therefore an object of the present invention to provide cost-effective means for cleaning and degreasing metals that obviate the use of hazardous cleaning solvents such as non-aqueous hydrocarbon solvents, especially conventional chlorinated hydrocarbon degreasing solvents.

This object and other objects, features and advantages will be seen from the following detailed description of the invention.

DISCLOSURE OF THE INVENTION

The invention in one preferred aspect concerns storage stable water based compositions for metal cleaning or degreasing. The compositions in one preferred embodiment comprise water, about 5 to about 20% by weight of water insoluble lipophilic organic solvent and a coupling agent comprising a compound having the formula

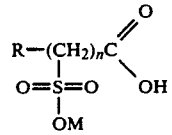

I where $R—(CH_2)_n$ is the residue of a sulfonated mono-un saturated $C_{12}$ to $C_{18}$ fatty acid having the C—S attachment in one of the carbon atoms of the residue and M is an alkali metal, alkaline earth metal or amine, the weight ratio of solvent to coupling agent being from about 1:1 to 2:1. A preferred coupling agent compound is sulfonated oleic acid, sodium salt. The aqueous compositions of the invention either in concentrated aqueous form, or diluted with water to provide a working solution, advantageously are storage stable and, for metal cleaning and degreasing, completely replace the prior non-aqueous chlorinated hydrocarbon cleaning solvents. In this regard, the compositions comprise water insoluble halogenated hydrocarbon solvents, as indicated, but only in relatively low proportion so that the compositions are environmentally safe. Any of various halogenated hydrocarbon solvents or mixtures can be used, preferably those boiling in the range from about 60° to about 160° C. Among these solvents may be mentioned chlorinated, fluorinated, and chlorofluorinated solvents such as trichloroethylene ($CCl_2{=}CHCl$), 1,1,1-trichloroethane ($CH_3CCl_3$), tetrachloroethylene $Cl_2C{=}CCl_2$), 1,1,2,2-tetrachloroethane ($Cl_2CHCHCl_2$), $CF_4$, $CHF_3$, $CCl_2FCCl_2F$, $CCl_3CF_3$, $CCl_2FCCl_2F$, $CClF_2CF_3$, and like solvents.

The invention is based on the unexpected finding that a coupling agent comprising a compound having the above formula I provides a stable, water dilutable true solution in which the desirable properties of halogenated cleaning solvents are maintained. Another important characteristic of the coupling agent is that it enables one to use surfactants that are primarily water soluble with a relatively high so-called hydrophilic lipophilic balance (HLB) value. For an explanation of the concept of HLB, see the review article of Paul Becher and William C. Griffin, Detergents and Emulsifiers, page 227, 1974. The fact that one need not use a primary emulsifier with a low HLB value to couple in the water insoluble solvent permits one to easily separate the removed oil and oily soil in the cleaning process, thus permitting the continuous use of the cleaning solution. It is found, according to the present invention, that sulfonated fatty acid (as the water soluble metal salt or amine salt) corresponding to the above formula not only permits one to compound a stable solution containing both water and water insoluble halogenated solvents, but also permits the use of other primarily water soluble surfactants resulting in excellent wetting properties and only minimal oil emulsification. In this way, the soil is removed by the solvents, aided by the wetting agents which serve to lower the surface tension between the solution and the metal surface, and the removed oily soil is easily separated. In the absence of the coupling agent, large amounts of oil-water soluble surfactants/emulsifiers must be used to provide a stable solution and even then the formulation does not release the removed oil. It is found, advantageously, that surfactants having an HLB value higher than 10.0 incorporated in the cleaning compositions of the invention contribute to the cleaning process without forming a stable emulsion with the removed oily soil.

The lipophilic organic solvent of the compositions of the invention may be any solvent or mixture of solvents that is essentially water insoluble but capable of dissolving oils, fats and the like, and that may be made water soluble by using the coupling agent described above. Examples of suitable solvents are ether compounds of secondary alcohols such as ethylene glycol phenyl ether (EGPE); cyclic alcohols such as cyclohexanol; cyclic ketones such as cyclohexanone; heterocyclic alcohols such as furfuryl alcohol; and the halogenated hydrocarbon solvents described above, such as 1,1,1-trichloroethane (1,1,1-TCE). Preferred solvents are 1,1,1-TCE, EGPE, and cyclohexanol. The latter can each be used in place of 1,1,1-TCE. A preferred weight ratio between water insoluble and water soluble solvents is 2:1 to 1:2.

Preferred embodiments of the invention are illustrated, and the best mode of practicing the invention is described, in the following examples.

EXAMPLE 1

| Formula I | % By Weight | Order of Formulation |
|---|---|---|
| Nonionic surfactant* | 3.0 | 4 |
| Tetrapotassiumpyrophosphate (TKPP) | 4.0 | 7 |
| Potassium metasilicate** | 4.0 | 6 |
| Sulfonated Oleic Acid, Na salt | 6.0 | 2 |
| Ethylene Glycol Butyl Ether (EGBE) | 5.0 | 3 |
| 1,1,1-Trichloroethane (TCE) | 8.0 | 5 |
| Water, deionized | balance to 100.0 | 1,8 |

*Alkyl (octyl or nonyl) Phenol Ethylene Oxide adduct, 10–12 moles of Ethylene Oxide present.

**may be substituted with alkali silicates, subsilicates, alkali metal hydroxides, and alkali metal phosphates.

This product is a highly alkaline cleaning compound, having an as is pH of 13.2. It is especially suited to remove fat containing soil from ferrous metals; it may be used as is, or diluted with water 1:1 to 1:19; optimum temperature 60°–120° F.

Formula 1a

Formula 1 is used with the addition of 3.0% sodium nitrite and with the corresponding reduction of the water content.

Test Panel Comparison: Two sets of identical 4×6 cold rolled steel test panels are coated with light oil, then the oil is removed by cleaning or immersing one panel set in a solution made by diluting 1 part of Formula 1 in 3 parts of water and the other panel set in a solution of Formula 1a, one part with 3 parts of water. The panels were observed after 96 hours of indoor storage; panels cleaned in Formula 1 showed slight rust while the panels cleaned in Formula 1a solution showed no rust. Other organic or inorganic rust or general oxidation preventative agents may be used in conjunction with or instead of sodium nitrite: typically, amine salts of p-tertiary, butyl benzoic acid; amine or Na or K salts of boric acid.

The purpose of the ethylene glycol butyl ether (EGBE) is to increase the soil removal using an essentially water soluble solvent with the chlorinated hydrocarbon solvent to permit better separation of the oily soil. Many other water soluble solvents may be employed, which may include $C_1$ to $C_5$ primary alcohols. Secondary alcohols and derivatives, and heterocyclic primary alcohols, like tetrahydrofurfuryl alcohol may be used in both Formula 1 and 1a; of the many solvents screened, EGBE or THFA performed well.

| Formula 1b | % By Weight | Order of Formulation |
|---|---|---|
| Nonionic surfactant | 3.0 | 4 |
| TKPP | 4.0 | 7 |
| Potassium Metasilicate | 4.0 | 6 |
| Cyclohexanol | 6.0 | 5 |
| Tetra Hydro Furfuryl Alc. | 4.0 | 3 |
| Sulf. Oleic Acid, Na salt | 7.0 | 2 |
| Water, deionized | balance to 100.0 | 1 |

Cyclohexanol may be substituted by EGPE.

Using this formula in 3 different dilutions, (as is, 10% solution and 50% solution in water) the oil removal capacities are equal to that of Formula 1 when diluted in the same manner.

EXAMPLE 2

This formulation, using again the sulfonated oleic acid solubilized 1,1,1 trichloroethane (TCE), is effective where high pH and saponification are not desired, for example when cleaning non-ferrous metals.

| Formula 2 | % By Weight |
|---|---|
| TKPP | 4.0 |
| Nonionic surf. | 4.0 |
| Sulf. Oleic Acid, Na | 6.0 |
| Coconut Alkanoamide | 4.0 |
| EGBE | 4.0 |
| Pine Oil | 2.0 |
| Isopropyl alcohol | 2.0 |
| 1,1,1 TCE | 12.0 |
| water, deionized | balance to 100.0 |

This formula has an as is pH of 8.12; it has excellent cleaning properties without alkalinity. Also, the formula has an additional water insoluble solvent (Pine Oil) balanced with an additional water soluble solvent (IPA) to further improve the removal of oils and fats in essentially neutral media. For protection against rust or corrosion with ferrous metals, the addition of 3–5% sodium nitrite is recommended. For use on aluminum, the addition of 0.5 to 1.0% of sodium silicate (anhydrous basis) is recommended per Formula 3 below. A preferred variation of Formula 2 may be prepared by replacing 1,1,1-trichloroethane with cyclohexanol or ethylene glycol phenylether. The results and advantages obtained with this variation are comparable to those obtained with other preferred embodiments of the formulations described herein.

EXAMPLE 3

| Formula 3 | % By Weight |
|---|---|
| Sodium Silicate 38–40%, 1 $Na_2O$: 3.22 $SiO_2$ | 1.2 |
| TKPP | 4.0 |
| Nonionic surf. | 4.0 |
| Sulf. Oleic Acid, Na | 6.0 |
| Coconut Alkanoamide | 4.0 |
| EGBE | 4.0 |
| Pine Oil | 2.0 |
| Isopropyl alcohol | 2.0 |
| 1,1,1 TCE | 8.0 |

-continued

| EXAMPLE 3 | |
|---|---|
| Formula 3 | % By Weight |
| water, deionized | balance to 100.0 |

Following Military Specification MIL-C-25769H 4.5.7 (1 through 3) the panels prepared and cleaned as described in 4.5.7.3 passed all requirements and showed no visual signs of pitting or discoloration. A preferred variation of Formula 3 may be prepared by replacing 1,1,1-trichloroethane with cyclohexanol or ethylene glycol phenylether. The results and advantages obtained with this variation are comparable to those obtained with other preferred embodiments of the formulations described herein.

| EXAMPLE 4 | |
|---|---|
| Cleaning and oxide removing formula for ferrous metals. | |
| Formula 4 | % By Weight |
| Phosphoric Acid 75% | 5.0 |
| Gluconic Acid | 2.0 |
| Sulf. Oleic Acid, Na | 6.5 |
| Coconut Alkanoamide | 2.0 |
| EGBE | 4.0 |
| IPA | 2.0 |
| Nonionic surf. | 3.0 |
| 1,1,1 TCE | 8.0 |
| water, deionized | balance to 100.0 |

8 panels (mild cold rolled steel 4×6 inches, unprotected) were exposed to outdoor storage for 1 week; varying degrees of rust appeared on the surface. The rusted panels were soiled using 2 grams of used oil and 3 grams of a pigmented drawing compound per panel.

Formula 4 was diluted with 3 parts of water and the panels were exposed to the resulting cleaning-deoxidizing solution for 20 minutes at 70°, 100° and 120° F. The soil was removed at all 3 temperatures: at 70° F., 70–80% of the rust was removed; at 100° F., 80–85%; and at 120°, 90–95%. At 120° F., the rust removal was accompanied by a slight darkening of the metal.

The amount of the phosphoric acid may be increased up to 15% when a large amount of rust from iron or steel surfaces is to be removed. The pH of the working solution is 1.84. A preferred variation of Formula 4 may be prepared by replacing 1,1,1-trichloroethane with cyclohexanol or ethylene glycol phenylether. The results and advantages obtained with this variation are comparable to those obtained with other preferred embodiments of the formulations described herein.

Oxide removing and cleaning compound for copper, brass or bronze.

| Formula 4a | % By Weight |
|---|---|
| Citric Acid | 4.0 |
| Hydroxyacetic Acid | 2.0 |
| Gluconic Acid | 2.0 |
| Sodium Acid Pyrophosphate | 0.5 |
| Ammonium Hydroxide 26% $NH_3$ | 1.8 |
| Nonionic surfactant | 2.0 |
| Sulf. Oleic Acid, Na | 6.0 |
| Coconut Alkanoamide | 2.0 |
| EGBE | 4.0 |
| 1,1,1 TCE | 10.0 |
| water, deionized | balance to 100.0 |

This formula is a clear, stable, water dilutable product, (adjusted, when needed with either citric acid or ammonium hydroxide). At 85° F., diluted by 4 parts of water, it cleaned and deoxidized copper, brass and bronze panels in 10 minutes with agitation. This formula may be used in a conventional or ultrasonic cleaning unit or in a burnishing, deburring or buffing machine. A preferred variation of Formula 4a may be prepared by replacing 1,1,1-trichloroethane with cyclohexanol or ethylene glycol phenylether. The results and advantages obtained with this variation are comparable to those obtained with other preferred embodiments of the formulations described herein.

Phosphatizing and cleaning compounds; comparison of a typical prior art composition with one of the invention. A typical prior art compound is as follows:

| | |
|---|---|
| Mono sodium phosphate | 10% |
| Nonionic surfactant | 2% |
| EGBE or similar | 5% |
| Sodium Xylene Sulfonate | 5% (coupling agent) |
| Water | balance to 100.0 |

This type of product serves to apply phosphate coating on a relatively clean steel; whenever the steel parts are heavily contaminated they must be precleaned.

The formulation of the invention disclosed below serves both to clean and to phosphatize heavily contaminated steel parts evenly and effectively:

| Formula 5 | % By Weight |
|---|---|
| Mono Sodium Phosphate | 8.0 |
| Sodium Acid Pyrophosphate | 2.0 |
| Nonionic surfactant | 2.5 |
| Coconut Alkanoamide | 1.5 |
| Sulf. Oleic Acid, Na | 6.5 |
| EGBE | 4.0 |
| 1,1,1 TCE | 10.0 |
| IPA | 2.5 |
| water | balance to 100.0 |

A solution of 1 part of Formula 5 with 6 parts of water was prepared, and oil-contaminated mild steel panels were immersed for 8 minutes at 150° F. in the solution. The panels showed uniform cleaning and phosphate coating of 48 mg/ft$^2$. The formula permits the incorporation of known accelerators, like sodium chlorate, ammonium molybdate, sodium tungstate, dinitrobenzenesulfonate and others. Lowering the temperature to 120° F. and extending the time to 15 minutes provides excellent cleaning and a uniform (38 mg/ft$^2$) coating. The pH of the working solution is 4.6. A preferred variations of Formula 5 may be prepared by replacing 1,1,1-trichloroethane with cyclohexanol or ethylene glycol phenylether. The results and advantages obtained with this variation are comparable to those obtained with other preferred embodiments of the formulations described herein.

| EXAMPLE 6 | |
|---|---|
| Formula 6 | % By Weight |
| Ethylene Diamine Tetraacetate | 1.0 |
| Diethanoleamine | 4.0 |
| Monoethanolamine Borate | 5.0 |
| Sodium Nitrite | 2.0 |
| Coconut Diethanolamide (Ninol 1281, by Stepan Chem. Co.) | 4.0 |
| UCON HB 660 (Union Carbide Co.) | 3.0 |
| Organic Phosphate Ester (Antara LP 700 by GAF Corp) | 3.0 |
| Sulf. Oleic Acid Na | 6.0 |

-continued

EXAMPLE 6

| Formula 6 | % By Weight |
|---|---|
| 1,1,1 TCE | 10.0 |
| water, deionized | balance to 100.0 |

This product at the 2% and 5% working solution level (pH 8.92 and 9.05 respectively) in a commercial cleaning machine made by Blanchard Co. with a specially hardened steel stock, provided excellent lubricity and easy machining in conjunction with the necessary cleaning of the part to be machined. The freshly ground, clean part showed no sign of discoloration or corrosion.

Cleaning efficiency and oil recovery:

Ten cold rolled mild steel panels, 4×6 inches, were weighed on an analytical balance; total weight 1,148.56 grams. The panels were oil coated with 5.0 grams of dyed 100 napthenic oil per panel, 50.0 gram total, and inserted into 2,000 ml of cleaning solution as described in Formula #1. The solution was agitated for 15 minutes followed by a 2-minute rinse cycle using deionized water sprayed at 90 psi with 4 nozzles per panel.

Ten other panels were cleaned in a conventional degreasing unit using 1,1,1-TCE as the solvent; weight: 1,152.08 grams metal+50.0 grams oil. Following the cleaning cycle, the panels were dried and weighed. The dyed oil accumulated as a supernatant layer on the cleaning solution; the oil was removed from the panels using a laboratory centrifuge (5,000 rpm in two 10-minute cycles) and weighed. The results are shown in Table 1.

TABLE 1

| | Panels Cleaned in Formula 1 | Panels Cleaned in 100% 1,1,1-TCE |
|---|---|---|
| Original Weight of 10 Panels | 1,148.56 | 1,152.08 |
| Weight of Panels After Cleaning As Described | 1,149.12 | 1,152.54 |
| % change | 0.049 | 0.040 |
| Oil Recovered After Centrifuge | 47.8 g (95.6%) | none |

The actual oil recovery is influenced by the total volume of solution present. Whenever the cleaning solution (in this case Formula 1) was completely saturated with oil, the separation of the removed oil was nearly 100%. The saturation level is 1.6–2.0%, and this amount does not effect the cleaning ability. The recovered oil was analyzed between 7 to 42 ppm for total organic halogen, and this low amount represents a clear advantage over 100% halogenated solvents used in degreasing units. The latter solvents were distilled either continuously or periodically to remove the dissolved oily soil and produce fresh solvent; the distillation residue usually contained not less than 5% halogenated solvent and most of the time much more, making it very difficult and expensive to dispose of the distillation bottoms.

In contrast, the formulations of the invention disclosed herein have the advantage of separating the removed soil by employing simple oil skimmers or centrifuges; the oil contains no perceptible halogenated solvent or only very slight amounts thereof. The mostly oil-free solution can be filtered continuously (or periodically when needed), thus eliminating an expensive installation and a difficult waste disposal problem.

A preferred variation of Formula 6 may be prepared by replacing 1,1,1-trichloroethane with cyclohexanol or ethylene glycol phenylether. The results and advantages obtained with this variation are comparable to those obtained with other preferred embodiments of the formulations described herein.

What is desired to claim as our exclusive property in the invention is the following:

1. A storage stable water based metal cleaning and degreasing composition comprising water, about 5 to about 20% by weight of water insoluble lipophilic organic solvent and a coupling agent comprising a compound having the formula

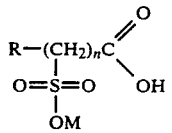

I where $R—(CH_2)_n$ is the residue of a sulfonated monounsaturated $C_{12}$ to $C_{18}$ fatty acid having the C—S attachment in one of the carbon atoms of the residue and M is an alkali metal, alkaline earth metal or amine, the weight ratio of solvent to coupling agent being from about 1:1 to 2:1.

2. A composition according to claim 1 containing surfactant.

3. A composition according to claim 2 where the surfactant has a hydrophilic lipophilic balance (HLB) value greater than about 10.0.

4. A composition according to claim 1 containing a water soluble solvent.

5. A composition according to claim 4 where the water soluble solvent comprises alkylene glycol alkyl ether.

6. A composition according to claim 4 where the water soluble oil solvent comprises a low molecular weight aliphatic alcohol.

7. A composition according to claim 1 where the coupling agent comprises sulfonated oleic acid sodium salt.

8. A water dilutable composition according to claim 1 having a pH range of about 0.5 to 14.

9. A water dilutable composition according to claim 1 having a pH range of about 7 to 14.

10. A water dilutable composition according to claim 1 having a pH range of about 1.5 to about 5.

11. A method of degreasing metal comprising the step of cleaning the metal with a working solution of a composition according to claim 1 and the optional step of rinsing the thus cleaned metal.

12. A method of degreasing metal according to claim 11 where the working solution contains surfactant and water soluble oil solvent, comprising the step of recovering oil separating from the working solution used in the cleaning step.

13. A method of degreasing metal according to claim 12, comprising the steps of rinsing the cleaned metal with an aqueous rinse and recovering oil separating from the rinse.

14. A method of cleaning metal comprising the step of cleaning the metal with a working solution according to claim 1 optionally containing an effective amount of a rust removing agent.

15. A method of phosphatizing metal comprising the step of cleaning the metal with a working solution according to claim 1 containing an effective amount of a phosphatizing agent.

* * * * *